US010570567B2

(12) United States Patent
Lu et al.

(10) Patent No.: US 10,570,567 B2
(45) Date of Patent: Feb. 25, 2020

(54) SOFTENER COMPOSITION

(71) Applicant: Kemira Oyj, Helsinki (FI)

(72) Inventors: Chen Lu, Marietta, GA (US); Clayton Campbell, Easton, MD (US); Jenna Sue Rabideau, Rydal, GA (US)

(73) Assignee: KEMIRA OYJ, Helsinki (FI)

( * ) Notice: Subject to any disclaimer, the term of this patent is extended or adjusted under 35 U.S.C. 154(b) by 0 days.

(21) Appl. No.: 15/543,661

(22) PCT Filed: Feb. 29, 2016

(86) PCT No.: PCT/US2016/019999
§ 371 (c)(1),
(2) Date: Jul. 14, 2017

(87) PCT Pub. No.: WO2017/151084
PCT Pub. Date: Sep. 8, 2017

(65) Prior Publication Data

US 2018/0105987 A1 Apr. 19, 2018

(51) Int. Cl.

| | |
|---|---|
| ***D21H 21/20*** | (2006.01) |
| ***D21H 17/37*** | (2006.01) |
| ***D21H 21/18*** | (2006.01) |
| ***D21H 23/04*** | (2006.01) |
| ***D21H 23/24*** | (2006.01) |
| ***D21H 21/10*** | (2006.01) |
| ***D21H 21/24*** | (2006.01) |
| ***D21H 27/00*** | (2006.01) |
| ***D21H 23/22*** | (2006.01) |
| ***D21H 21/22*** | (2006.01) |
| ***D21H 17/65*** | (2006.01) |
| ***D21H 17/07*** | (2006.01) |
| ***D21H 17/15*** | (2006.01) |

(52) U.S. Cl.
CPC ..... *D21H 21/20* (2013.01); *D21H 17/07* (2013.01); *D21H 17/15* (2013.01); *D21H 17/375* (2013.01); *D21H 17/65* (2013.01); *D21H 21/10* (2013.01); *D21H 21/18* (2013.01); *D21H 21/22* (2013.01); *D21H 21/24* (2013.01); *D21H 23/04* (2013.01); *D21H 23/22* (2013.01); *D21H 23/24* (2013.01); *D21H 27/002* (2013.01)

(58) Field of Classification Search
None
See application file for complete search history.

(56) References Cited

U.S. PATENT DOCUMENTS

| | | | | |
|---|---|---|---|---|
| 2,325,302 | A * | 7/1943 | Britt | D21H 17/50 162/166 |
| 3,372,085 | A * | 3/1968 | Westfall | C08G 18/0814 525/452 |
| 4,629,574 | A * | 12/1986 | Nuesslein | C11D 1/62 510/524 |
| 5,861,371 | A | 1/1999 | Wilsch-Irrgang et al. | |
| 6,458,343 | B1 | 10/2002 | Zeman et al. | |
| 2013/0160959 | A1* | 6/2013 | Rosencrance | D21H 17/56 162/164.6 |
| 2014/0262091 | A1* | 9/2014 | Lu | D21H 17/47 162/164.6 |
| 2014/0284011 | A1* | 9/2014 | Krapsch | D21C 5/02 162/168.3 |

FOREIGN PATENT DOCUMENTS

| | | | |
|---|---|---|---|
| EP | 0417987 | A2 | 3/1991 |
| WO | 9306294 | A1 | 4/1993 |
| WO | WO-93/21382 | A1 | 10/1993 |
| WO | 9611250 | A1 | 4/1996 |
| WO | WO-00/75426 | A1 | 12/2000 |
| WO | 2012041658 | A1 | 4/2012 |
| WO | WO-2015/075318 | A1 | 5/2015 |

OTHER PUBLICATIONS

Written Opinion of the International Searching Authority issued by the European Patent Office acting as the International Searching Authority in relation to International Patent Application No. PCT/US2016/019999 dated Nov. 24, 2016 (6 pages).
International Search Report issued by the European Patent Office acting as the International Searching Authority in relation to International Patent Application No. PCT/US2016/019999 dated Nov. 24, 2016 (5 pages).
Communication Pursuant to Article 94(3) EPC issued by the European Patent Office in relation to European Application No. 16710043.7 dated Jun. 24, 2019 (4 pages).

* cited by examiner

*Primary Examiner* — Necholus Ogden, Jr.
(74) *Attorney, Agent, or Firm* — Robert P. Michal, Esq.; Carter, DeLuca & Farrell LLP

(57) ABSTRACT

A softener composition for use in the manufacture of paper includes a softener and an acidic material, wherein the softener composition has a relative acidity (RA) value of more than 0.05.

5 Claims, No Drawings

SOFTENER COMPOSITION

CROSS-REFERENCE TO RELATED APPLICATIONS

This application is a National Phase Entry under 35 USC § 371 of PCT Patent Application Serial No, PCT/US2016/019999 filed Feb. 29, 2016, the disclosure of which is expressly incorporated herein by reference in its entirety.

FIELD OF THE INVENTION

The present invention relates to a softener composition. The present invention further relates to a method for producing a paper product and to a paper product produced by the method.

BACKGROUND

Paper is sheet material containing interconnected small, discrete fibers. The fibers are usually formed into a sheet on a fine screen from a dilute water suspension or slurry. Paper typically is made from cellulose fibers, although occasionally synthetic fibers may be applied. Paper products made from untreated cellulose fibers lose their strength rapidly when they become wet, i.e., they have very low wet strength. Wet strength resin can be added to paper to produce stronger paper products. The types of wet strength resins that can be applied to paper may either be of "permanent" or "temporary" type, which are defined, in part, by how long the paper retains its wet strength after immersion in water.

Wet strength of paper is defined to be a measure of how well the fiber web holds together upon a force of rupture when in contact with water. Various techniques, such as refining of the pulp and wet pressing on the paper machine, can be used to reduce the strength loss of the paper upon wetting. The wet strength resins may improve the dry strength of the paper, as well. Wet strength improves the tensile properties of the paper both in wet and dry state by crosslinking the cellulose fibers with covalent bonds that do not break upon wetting. Wet strength is routinely expressed as the ratio of wet to dry tensile breaking force.

During the papermaking process, aldehyde functionalized polymers, such as glyoxylated polyacrylamide (GPAM), are often added to the pulp suspension before paper sheet formation to increase wet strength. Upon drying of the treated paper sheet the aldehyde functionalized polymer is believed to form covalent bonds with cellulose to increase paper dry strength and wet strength. Since the formation of covalent bond between the aldehyde functionalized polymer and cellulose is reversible in water, paper wet strength will decrease over time in water. As a result, the aldehyde functionalized polymers are also used as a temporary wet strength agent for tissue papers.

The strength performance of aldehyde functionalized polymers, such as GPAM, is known to be adversely affected by relatively high pH and high levels of alkalinity. In the absence of alkalinity, the aldehyde functionalized polymers are highly effective at acidic and neutral conditions. However, Increasing pH of the aqueous solution to a value above 7 will result in significant strength loss. With alkalinity level of 50 ppm ($CaCO_3$) or higher, the strength performance of aldehyde functionalized polymers, such as GPAM, is impaired even at neutral pH conditions.

The negative effect of pH and alkalinity limits the application of the aldehyde functionalized polymer in many paper grades.

Papermakers often add strong acids to the pulp slurry during the papermaking process to enhance the performance of the aldehyde functionalized polymer. However, large quantity of acid is needed to lower the pH under high alkalinity conditions. Furthermore, lowering the pH of the papermaking water causes other issues, such as corrosion and compromise of process chemicals. Adding acid directly into pulp slurry results often in immediate precipitation or deposition of certain dissolved and suspended chemicals and particles. The handling of corrosive strong acids is also a safety concern for paper machine operators.

Premium bath tissue products often require relatively low dry strength and improved softness but high wet strength when in contact with water.

Tissue paper softness is a complex tactile sensation experienced by customers. This tactile sensation is a combination of several physical properties including paper surface smoothness, paper stiffness, and also paper bulk (the inverse of paper density). It has always been desired from tissue makers to continue increasing softness while achieving a particular strength target.

Chemical softeners are frequently used for improve the tactile sensation of tissue paper products. Examples of chemical softeners are waxes such as paraffin, oils such as mineral oil, fatty acids, and surfactants.

It would be highly desirable to further increase softness of a paper product while maintaining high wet strength performance when in contact with water.

SUMMARY OF THE INVENTION

One object of the present invention is to provide a solution to the problems encountered in the prior art.

Specifically, the present invention aims at solving the problem of improving softness of a paper product, such as a tissue, while maintaining high wet strength performance.

One object of the present invention is to provide a softener composition which enhances paper product wet strength properties.

A further object of the present invention is to provide a softener composition with lowered viscosity.

A still further object of the present invention is to provide a paper product with high wet strength performance when in contact with water.

Yet, further object of the present invention is to provide a method for improving wet strength properties of a paper product.

Yet, a further object of the present invention is to provide a paper product having improved properties.

To achieve at least some of the above objects the invention is characterized by the features of the independent claims. Dependent claims represent the preferred embodiments of the invention.

It has been surprisingly found that the softener composition of the present invention enhances paper product, such as tissue, wet strength properties.

The softener composition comprises a softener and an acidic material. When used in combination with aldehyde functionalized polymer, such as GPAM, the addition of the acidic material enhances paper wet strength without any significant impacts on paper dry strength. The acidic material of the softener composition adjusts the pH in the vicinity of the aldehyde functionalized polymer in paper making for improving the strength performance of the aldehyde functionalized polymer. Consequently, the application of the softener composition in combination with the aldehyde functionalized polymer provides paper products with high wet strength/dry strength ratios which are highly desirable for many tissue products.

A further benefit is avoiding need for pH adjustment of the pulp slurry for the performance of the aldehyde functionalized polymer, instead the process can be run in the prevailing pH.

Yet further benefits include the possibility to control scale formation, the felt stays cleaner and the felt life and performance are increased.

Furthermore, the invention also demonstrated that the acidic material lowered viscosity of softener, such as imidazolinium, emulsions. Therefore, softeners can be emulsified at significant higher concentrations, resulting in lower shipping/handling cost.

Another advantage is that the method is technically simple to perform and therefore very cost efficient. When the acidic material is added on the surface of the paper, the alkalinity is effectively removed from the sheet layer by using low amount of the acid.

Even though the glyoxylated polyacrylamide (GPAM) is applied in the examples, the method of the present invention is applicable also to other aldehyde functionalized polymers.

Hence, in one aspect, the present invention provides a softener composition for use in manufacture of a paper product comprising a softener and an acidic material, wherein the softener composition has a relative acidity (RA) value of more than 0.05 (defined below).

In a second aspect, the present invention provides a method for manufacturing a paper product, which comprises the steps of providing a pulp slurry, forming a web from the pulp slurry, drying the web, adding the disclosed softener composition (i) to the pulp slurry before the web formation, (ii) on the web before, during and/or after the drying, and/or (iii) on wire, on forming fabric or on Yankee dryer on the web-contacting side.

In a third aspect, the present invention provides a paper product produced by the method.

In a fourth aspect, the present invention provides a treatment system for fibers in the manufacture of paper comprising the softener composition and an aldehyde functionalized polymer.

DETAILED DESCRIPTION OF THE INVENTION

As used herein, the terms "paper" or "paper product" which can be used interchangeably, are understood to include a sheet material that contains paper fibers, which may also contain other materials (e.g. organic particles, inorganic particles, and a combination thereof). Suitable paper fibers include natural and synthetic fibers, for example, cellulosic fibers, wood fibers of all varieties used in papermaking, other plant fibers, such as cotton fibers, fibers derived from recycled paper; and the synthetic fibers, such as rayon, nylon, fiberglass, or polyolefin fibers. Natural fibers may be mixed with synthetic fibers. For instance, in the preparation of the paper product, the paper web, or paper material may be reinforced with synthetic fibers, such as nylon or fiberglass, or impregnated with nonfibrous materials, such as plastics, polymers, resins, or lotions. As used herein, the terms "paper web" and "web" are understood to include both forming and formed paper sheet materials, papers, and paper materials containing paper fibers. The paper product may be a coated, laminated, or composite paper material. Moreover, the paper product can be bleached or unbleached.

Paper can include, but is not limited to, writing papers and printing papers, such as uncoated mechanical, total coated paper, coated free sheet, coated mechanical, uncoated free sheet, and the like; industrial papers, tissue papers of all varieties, paperboards, cardboards, packaging papers, such as unbleached kraft paper or bleached kraft paper, wrapping papers, paper adhesive tapes, paper bags, paper cloths, toweling, wallpapers, carpet backings, paper filters, paper mats, decorative papers, disposable linens and garments, and the like.

Paper can include tissue paper products. Tissue paper products include sanitary tissues, household tissues, industrial tissues, facial tissues, cosmetic tissues, soft tissues, absorbent tissues, medicated tissues, toilet papers, paper towels, paper napkins, paper cloths, paper linens, and the like.

In an exemplary embodiment, tissue paper may be a felt pressed tissue paper, a pattern densified tissue paper, or a high bulk, uncompacted tissue paper. In another exemplary embodiment, the tissue paper may be creped or uncreped, of a homogeneous or multilayered construction, layered or non-layered (blended), and one-ply, two-ply, or three or more plies. In an exemplary embodiment, tissue paper includes soft and absorbent paper tissue products that are consumer tissue products.

In one preferred embodiment the paper product is tissue paper product. "Paperboard" is paper that is thicker, heavier, and less flexible than conventional paper. Many hardwood and softwood tree species are used to produce paper pulp by mechanical and chemical processes that separate the fibers from the wood matrix. Paperboard can include, but is not limited to, semi-chemical paperboard, linerboards, containerboards, corrugated medium, folding boxboard, and cartonboards.

In an exemplary embodiment, paper refers to a paper product such as dry paper board, fine paper, towel, tissue, and newsprint products. Dry paper board applications include liner, corrugated medium, bleached, and unbleached dry paper board.

In an embodiment, paper can include carton board, container board, and special board/paper. Paper can include boxboard, folding boxboard, unbleached kraft board, recycled board, food packaging board, white lined chipboard, solid bleached board, solid unbleached board, liquid paper board, linerboard, corrugated board, core board, wallpaper base, plaster board, book bindery board, wood pulp board, sack board, coated board, gypsum board and the like.

'Pulp' refers to a fibrous cellulosic material. Suitable fibers for the production of the pulps are all conventional grades, for example mechanical pulp, bleached and unbleached chemical pulp, recycled pulp, and paper stocks obtained from all annuals. Mechanical pulp includes, for example, groundwood, thermomechanical pulp (TMP), chemothermochemical pulp (CTMP), alkaline peroxide mechanical pulp (APMP), groundwood pulp produced by pressurized grinding, semi-chemical pulp, high-yield chemical pulp and refiner mechanical pulp (RMP). Examples of suitable chemical pulps are sulfate, sulfite, and soda pulps. The unbleached chemical pulps, which are also referred to as unbleached kraft pulp, can be particularly used.

"Pulp slurry" refers to a mixture of pulp and water. The pulp slurry is prepared in practice using water, which can be partially or completely recycled from the paper machine. It can be either treated or untreated white water or a mixture of such water qualities. The pulp slurry may contain interfering substances, such as fillers. The filler content of paper may be up to about 40% by weight. Suitable fillers are, for example, clay, kaolin, natural and precipitated chalk, titanium dioxide, talc, calcium sulfate, barium sulfate, alumina, satin white or mixtures of the stated fillers.

"Papermaking process" is a method of making paper products from pulp comprising, inter alia, forming an aqueous pulp slurry that can include cellulosic fiber, draining the pulp slurry to form a sheet (web), and drying the sheet. The steps of forming the papermaking furnish, draining, and drying may be carried out in any conventional manner generally known to those skilled in the art.

"Paper strength" means a property of a paper material, and can be expressed, inter alia, in terms of dry strength and/or wet strength.

"Dry tensile strength" (also called dry strength) is the tensile strength exhibited by the dry paper sheet, typically conditioned under uniform humidity and room temperature conditions prior to testing. Dry tensile strength is measured by applying a constant-rate-of-elongation to a sample and recording the force per unit width required to break a specimen. The test can be carried out as described in TAPPI Test Method T494 (2001), and modified as described in the examples.

Initial wet tensile strength (also called initial wet strength) test method is used to determine the initial wet tensile strength of paper or paperboard that has been in contact with water for 2 seconds. A 1-inch wide paper strip sample is placed in the tensile testing machine and wetted on both strip sides with deionized water by a paint brush. After the contact time of 2 seconds, the strip is elongated as set forth in 6.8-6.10 TAPPI test method 494 (2001). The initial wet tensile strength is useful in the evaluation of the performance characteristics of tissue product, paper towels and other papers subjected to stress during processing or use while instantly wet.

Permanent wet tensile strength (also called permanent wet strength) test method is used to determine the wet tensile strength of paper or paperboard that has been in contact with water for an extended period of 30 minutes. A 1-inch wide paper strip sample is soaked in water for 30 minutes and is placed in the tensile testing machine. The strip is elongated as set forth in 6.8-6.10 of TAPPI Test Method 494(2001). A low permanent wet tensile strength indicates that the paper product can be repulped in water without significant mechanical energy or dispersed in water easily without clogging sewage systems.

Wet tensile decay is used to measure the percentage of wet tensile loss of permanent wet tensile strength as compared to initial wet tensile strength. Wet tensile decay is defined as the difference between the initial wet tensile strength and the permanent wet strength, divided by the initial wet strength.

Common means for controlling paper strength is the choice of fibers and their mechanical treatment (refining). Virgin fibers, especially Kraft softwood, produce the strongest sheet, but this pulp is costly. Driven by the high cost of virgin fibers and also by environmental pressure, especially the tissue industry has moved towards greater use of less expensive recycled fibers, which inherently produce a weaker sheet. Furthermore, the quality and availability of recycled fibers have been deteriorating dramatically in the latest decade, creating challenges for the papermaking industry. Improving paper dry strength by increased refining is not trouble-free because it increases also dusting during production.

Combination of improved dry and wet strength is desirable because it allows increased running speeds and thus increases productivity. In tissue and towel production, it is also common to follow the wet/dry ratio, which is the wet tensile strength expressed as a percentage of the dry tensile strength. Since a higher dry tensile is associated with a stiffer sheet, a high wet/dry ratio is preferred for tissue and towel to minimize a negative impact on handfeel softness. In addition to strength properties, also appearance related characteristics such as brightness and shade are important for many paper grades and their improvement is desired.

"Aldehyde functionalized polymer" means a synthetic or natural polymer comprising aldehyde functionalities along the polymer backbone and/or along the side chains of the polymer, and it is capable of forming acetal bonds with cellulose to increase paper initial wet strength.

In one aspect, the present invention provides a softener composition. More particularly there is provided a softener composition for use in manufacture of a paper comprising a softener and an acidic material, wherein the softener composition has a relative acidity (RA) value of more than 0.05.

The Relative Acidity (RA) is defined as $$RA = \frac{TA}{c_s}$$

where TA is the total acidity of the composition in $CaCO_3$ equivalent (g/l), $c_s$ is the concentration of softener (g/l) in the composition. TA can be determined experimentally by neutralizing the composition above pH 8.3 with a standard NaOH solution (phenolphthalein indicator). TA is calculated as $$TA = \frac{V_1 \times N_1 \times EW(CaCO_3)}{V_2}$$

where $V_1$ is the volume (l) of the standard NaOH solution required to raise the composition pH above 8.3 (phenolphthalein acidity), N, is the normality (eq/l) of the standard NaOH solution, $EW(CaCO_3)$ is the equivalent weight of $CaCO_3$ which is 50 g/eq, and $V_2$ is the volume (l) of the softener composition titrated. Commercial titration kits can also be applied to determine TA. Examples of commercial TA titration kits are HACH Acidity Test Kit Model AC DT and HACH Acidity Test Kit Model AC-6.

TA values of citric acid were estimated theoretically in this invention based on the following equation $$TA(\text{citric}) = c_c \times \frac{EW(CaCO_3)}{EW(\text{citric})}$$

where $c_c$ is the concentration of citric acid and EW(citric) is the equivalent weight of citric acid which is 64 g/eq, which is the molar mass 192.12 g·mol−1 divided by number of acid groups which is three.

In one embodiment the RA value is at least 0.06, preferably at least 0.07, more preferably from more than 0.05 to 100, more preferably from 0.07 to 100, even more preferably from 0.07 to 30.

By the term "acidic material" herein is meant chemicals or substances having the property of an acid. Acids comprise acidic materials functioning as acids in the paper manufacturing environment. There are three common definitions available for acids: the Arrhenius definition, the Brønsted-Lowry definition, and the Lewis definition. The Arrhenius definition defines acids as substances which increase the concentration of hydrogen ions ($H^+$), or more accurately, hydronium ions ($H_3O^+$), when dissolved in water. The Brønsted-Lowry definition is an expansion: an acid is a substance which can act as a proton donor. By this definition, any compound which can easily be deprotonated can be considered an acid. Examples include alcohols and amines which contain O—H or N—H fragments. A Lewis acid is a substance that can accept a pair of electrons to form a covalent bond. Examples of Lewis acids include all metal cations, and electron-deficient molecules such as boron trifluoride and aluminium trichloride. Depending on the chosen chemical to be applied in the method of the present invention all definitions may be applied.

The acidic material may be a water soluble acid. The solubility is preferably at least 0.1 g/l at 20° C., depending on the pKa value of the acid or pH value obtainable at the paper sheet surface. More preferably, the water solubility is at least 0.5 g/l at 20° C. Most preferably, the acidic material is totally miscible, enabling any desired application concentration.

The water soluble acid may be a mineral acid or organic acid or a mixture thereof. These acids are relatively strong, easily available and typically used in papermaking.

Examples of suitable mineral acids are phosphoric acid, boric acid, sulfuric acid, hydrochloric acid, nitric acid, or any mixture thereof. The mineral acids enhance paper strength properties. Even partly deprotonated mineral acids may be used.

Examples of suitable organic acids are formic acid, acetic acid, citric acid, lactic acid, adipic acid, malic acid, or any mixture thereof. The organic acid increases acidity without lowering the paper sheet pH significantly. Organic acids are safe to use. Formic acid, acetic acid and lactic acid are totally miscible with water enabling any desired concentration. The solubility of citric acid in 20° C. water is about 1478 g/l, and the solubility of malic acid is 558 g/l.

The water soluble acidic material may also be an acrylic acid-containing polymer or the like which are paper strength resins or processing aids such as retention, formation, drainage or flocculants by themselves, thereby providing additional papermaking process enhancement; a conjugate acid of a weak base, in particular ammonium chloride, or the like which can be applied without lowering water pH significantly; an amine-containing polymer in salt form such as polyvinylamine, polyethylenimine, polyamidoamine; or a mixture thereof.

In one embodiment the acidic material is a mixture of any of the mineral acids, the organic acids, the acrylic acid-containing polymer, the conjugate acid of a weak base and the amine-containing polymer in salt form.

In one embodiment the softener of the softener composition of the present invention is capable of reducing paper surface friction coefficient, increasing paper surface lubricity, reducing paper stiffness, increasing paper bulk, reducing paper strength (wet and dry), plasticizing paper, and preventing fiber-fiber bonding (debonding).

The softener may be hydrophobic or amphiphilic material or a mixture thereof.

Examples of suitable softeners are softeners selected from a group of waxes such as paraffins; oils such as mineral oils, silicone oils or petrolatums or mixtures thereof; cationic surfactants such as imidazoline-based surfactants (quaternized or un-quaternized), fatty amines and their derivatives and salts, and cationic silicone compounds, or mixtures thereof; nonionic surfactants such as fatty alcohols, fatty amides, fatty acid esters, ethoxylated alcohols, ethoxylated fatty acids, alkyl polyglucosides, ethoxylated alkyl phenols, ethleneoxide/propyleneoxide copolymers or mixtures thereof; anionic surfactants such as fatty acids, sulfonates, sulfates, carboxylates, alkyl phosphates and anionic silicone surfactants or mixtures thereof; lubricants; and emollients such as lanolin and lecithin or mixtures thereof; or mixtures thereof.

In one preferred embodiment the softener is cationic surfactant, preferably imidazoline-based surfactant such as a reaction product of 9-octadecenoic acid (9Z)- with diethylenetriamine, cyclized, diethyl sulfate quaternized (CAS Reg. No. 68511-92-2), or dimethyl sulfate quaternized (CAS Reg. No. 72749-55-4).

In one embodiment weight ratio of the softener to the acidic material is from 100:1 to 1:100, preferably from 20:1 to 1:20.

The softener composition may optionally further comprise an aldehyde functionalized polymer.

In an exemplary embodiment, the aldehyde functionalized polymer of the present invention is produced by reacting a compound including one or more hydroxyl, amine, or amide groups with one or more aldehydes. Exemplary materials include urea-formaldehyde resins, melamine-formaldehyde resins, and phenol formaldehyde resins.

In another exemplary embodiment, the aldehyde functionalized polymer compounds comprise glyoxylated polyacrylamides, aldehyde-functional polysaccharides, aldehyde-rich cellulose, and aldehyde functional cationic, anionic or non-ionic starches.

Exemplary materials include those disclosed in U.S. Pat. No. 4,129,722. One example of a soluble cationic aldehyde functional starch is Cobond® 1000 (National Starch). Additional exemplary materials of aldehyde-functionalized polymers may include polymers such as those disclosed in U.S. Pat. No. 5,085,736; U.S. Pat. Nos. 6,274,667; and 6,224,714, as well as those of WO 00/43428 and the aldehyde functional cellulose described in WO 00/50462 A1 and WO 01/34903 A1.

In an exemplary embodiment, the aldehyde functional polymer has a weight average molecular weight of about 1,000 Dalton or greater, advantageously about 5,000 Dalton or greater, more advantageously about 20,000 Dalton or greater. The higher the molecular weight of the aldehyde functional polymer, the better the strength response in paper. Alternatively, the aldehyde functionalized polymer can have a molecular weight below about 10,000,000 Dalton, such as below about 1,000,000 Dalton.

In an exemplary embodiment, further examples of aldehyde functionalized polymers can include dialdehyde guar, aldehyde-functional wet strength additives further comprising carboxylic groups as disclosed in WO 01/83887, dialdehyde inulin, and the dialdehyde-modified anionic and amphoteric polyacrylamides of WO 00/11046.

In another exemplary embodiment, aldehyde-functionalized polymer is an aldehyde-containing surfactant such as those disclosed in U.S. Pat. No. 6,306,249.

In one embodiment, the aldehyde functionalized polymer has at least 5 millliequivalents (meq) of aldehyde per 100 grams of polymer, more specifically at least 10 meq, most specifically about 20 meq or greater, such as about 25 meq per 100 grams of polymer or greater. The higher the aldehyde content, the higher the strength increase due to higher number of bonds with cellulose. The aldehyde content of the aldehyde functionalized polymer may be determined by NMR, by UV- or colorimetric methods using dyes or labelling, by a method utilizing conductometric titration of carboxyls as disclosed in WO 00/50462, or by any other known method.

In one embodiment of the present invention the aldehyde functionalized polymer is glyoxylated polyacrylamide polymer (GPAM). GPAM provides enhanced paper dry strength and wet strength. As a synthetic polymer, it has controlled properties, improved stability, lower gelling tendency, and resistance towards microbial degradation, compared to natural aldehyde functionalized polymers. Additionally, GPAM provides better product safety compared to many other synthetic aldehyde functionalized polymers, such as those manufactured using formaldehyde. In one embodiment the aldehyde functionalized polymer is preferably charged glyoxylated polyacrylamide polymer, more preferably cationic glyoxylated polyacrylamide polymer. In an exemplary embodiment the GPAM is a cationic glyoxylated polyacrylamide as described in U.S. Pat. Nos. 3,556,932, 3,556,933, 4,605,702, 7,828,934, and U.S. Pat. No. 20080308242. Such compounds further include commercial products FENNOBOND™ 3000 and FENNOREZ™ 91 (Kemira Oyj).

In an exemplary embodiment, the aldehyde functionalized polymer is a glyoxalated polyacrylamide having the ratio of the number of substituted glyoxal groups to the number of glyoxal-reactive amide groups being in excess of about 0.03:1, being in excess of about 0.10:1, or being in excess of about 0.15:1. Higher ratios result in increased paper strength properties.

In an exemplary embodiment, the aldehyde functionalized polymer is a glyoxalated cationic polyacrylamide having a polyacrylamide backbone with a molar ratio of acrylamide to cationic monomer, such as dimethyldiallylammonium chloride, of about 99:1 to 50:50, about 98:1 to 60:40, or about 96:1 to 75:25. Presence of cationic charge in GPAM renders it self-retaining on cellulose, thereby facilitating the covalent bond formation between GPAM and the cellulose upon drying In an exemplary embodiment, the weight average molecular weight of the polyacrylamide backbone of the glyoxalated polyacrylamide is about 5,000,000 Da or less, about 1,000,000 Da or less, or about 100,000 Da or less.

The aldehyde functionalized polymer may be in a form of a complex with another polymer. The complex formation may be based on opposite charges and/or covalent bonding. The aldehyde functionalized polymer may be in a form of a complex with any known paper additive polymer capable of forming complex with the aldehyde functionalized polymer, such as PAE, PPAE, or anionic polyacrylamide.

Advantageously, the aldehyde functionalized polymer is used together with at least one further strength additive to provide improved strength properties. These further strength additives comprise cationic polyamines, anionic polyacrylamides (APAM), cationic polyamide epichlorohydrin, polyvinylamine, polyethyleneimine, or mixtures thereof.

In an exemplary embodiment, the strength additive is a cationic polyamine, which is preferably selected from a secondary polyamine, an aliphatic amine, an aromatic amine, a polyalkylene polyamine (such as polyethylene polyamine, a polypropylene polyamine, a polybutylene polyamine, a polypentylene polyamine, a polyhexylene polyamine), a secondary aliphatic amine or a secondary aromatic amine. Advantageously, the cationic polyamine is selected from ethylene diamine (EDA), diethylenetriamine (DETA), triethylenetetramine (TETA), tetraethylenepentamine (TEPA), and dipropylenetriamine (DPTA), bishexamethylenetriamine (BHMT), N-methylbis(aminopropyl)amine (MBAPA), aminoethyl-piperazine (AEP), pentaethylenehexamine (PEHA), polyethyleneimine, and other polyalkylenepolyamines (e.g., spermine, spermidine), or mixtures thereof. For example, ethylene diamine (EDA), diethylenetriamine (DETA), triethylenetetramine (TETA), tetraethylenepentamine (TEPA), and dipropylenetriamine (DPTA) can be obtained in a reasonably pure form, but also as mixtures and various crude polyamine materials. For example, the mixture of polyethylene polyamines obtained by the reaction of ammonia and ethylene dichloride, refined only to the extent of removal of chlorides, water, excess ammonia, and ethylenediamine, is a satisfactory material. The cationic polyamines may further include polyamidoamine which is a condensation product of one or more of the polycarboxylic acids and/or a polycarboxylic acid derivatives with one or more of the polyalkylene polyamines such as dimethyl adipate, dimethyl malonate, diethyl malonate, dimethyl succinate, dimethyl glutarate and diethyl glutarate.

In an exemplary embodiment, the strength additive is anionic polyacrylamide (APAM), which is preferably a copolymer of anionic monomer and non-ionic monomers such as acrylamide or methacrylamide. Examples of suitable anionic monomers include acrylic acid, methacrylic acid, methacrylamide 2-acrylamido-2-methylpropane sulfonate (AMPS), styrene sulfonate, and mixture thereof as well as their corresponding water soluble or dispersible alkali metal and ammonium salts. The anionic high molecular weight polyacrylamides useful in this invention may also be either hydrolyzed acrylamide polymers or copolymers of acrylamide or its homologues, such as methacrylamide, with acrylic acid or its homologues, such as methacrylic acid, or with polymers of such vinyl monomers as maleic acid, itaconic acid, vinyl sulfonic acid, or other sulfonate containing monomers. Anionic polyacrylamides may contain sulfonate or phosphonate functional groups or mixtures thereof, and may be prepared by derivatizing polyacrylamide or polymethacrylamide polymers or copolymers. The most preferred high molecular weight anionic polyacrylamides are acrylic acid/acrylamide copolymers, and sulfonate containing polymers such as those prepared by the polymerization of such monomers as 2-acrylamide-2-methylpropane sulfonate, acrylamido methane sulfonate, acrylamido ethane sulfonate and 2-hydroxy-3-acrylamide propane sulfonate with acrylamide or other non-ionic vinyl monomer.

In another exemplary embodiment, the anionic polyacrylamide may further contain monomers other than the above described monomers, more specifically, nonionic monomers and cationic monomers, provided the net charge of the polymer is anionic. Examples of nonionic monomers include dialkylaminoalkyl (meth)acrylates such as dimethylaminoethyl (meth)acrylate; dialkylaminoalkyl (meth)acrylamides such as dialkylaminopropyl (meth)acrylamides; and N-vinylformamide, styrene, acrylonitrile, vinyl acetate, alkyl (meth)acrylates, alkoxyalkyl (meth)acrylates, and the like. Suitable cationic vinyl monomers may include: dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA HCl), diallyldimethylammonium chloride (DADMAC), methacrylamidopropyltrimethylammonium chloride (MAPTAC), vinylpyridine, vinylimidazole, and allyl amine (ALA).

In another exemplary embodiment, the anionic polyacrylamide may further contain monomers other than the above described monomers, more specifically, nonionic monomers and cationic monomers, provided the net charge of the polymer is anionic. Examples of nonionic monomers include dialkylaminoalkyl (meth)acrylates such as dimethylaminoethyl (meth)acrylate; dialkylaminoalkyl (meth)acrylamides such as dialkylaminopropyl (meth)acrylamides; and N-vinylformamide, styrene, acrylonitrile, vinyl acetate, alkyl (meth)acrylates, alkoxyalkyl (meth)acrylates, and the like. Suitable cationic vinyl monomers may include: dimethylaminoethyl methacrylate (DMAEM), dimethylaminoethyl acrylate (DMAEA), diethylaminoethyl acrylate (DEAEA), diethylaminoethyl methacrylate (DEAEM) or their quatemary ammonium forms made with dimethyl sulfate or methyl chloride, Mannich reaction modified polyacrylamides, diallylcyclohexylamine hydrochloride (DACHA HCl), diallyldimethylammonium chloride (DADMAC), methacrylamidopropyltrimethylammonium chloride (MAPTAC), vinylpyridine, vinylimidazole, and allyl amine (ALA).

In an exemplary embodiment, the anionic polyacrylamide may have a standard viscosity higher than 1, preferably higher than 1.5, more preferably higher than 1.8. In an exemplary embodiment, the anionic polyacrylamide resin may have a charge density of about 1 to 100 wt %, preferably about 5 to 70 wt %, more preferably about 10 to 50 wt %. Anionic polyacrylamide is especially advantageous when glyoxylated cationic polyacrylamide as the aldehyde functionalized polymer is added in the wet-end, so as to facilitate ionic interactions between the components In an exemplary embodiment, the strength additive is cationic polyamidoamine epihalohydrin, which is preferably prepared by reacting one or more polyalkylene polyamines and one or more dicarboxylic acid compounds to form a polyamidoamine, and then reacting the polyamidoamine with epihalohydrin to form the polyamidoamine epihalohydrin resin. Advantageously, the cationic polyamide epihalohydrin includes epichlorohydrin, epifluorohydrin, epibromohydrin, epiiodohydrin, alkyl-substituted epihalohydrins, or a mixture thereof. Most advantageously, the epihalohydrin is epichlorohydrin.

In an exemplary embodiment, the strength additive is polyvinylamine, which is preferably a homopolymer or a copolymer. Useful copolymers of polyvinylamine include those prepared by hydrolyzing polyvinylformamide to various degrees to yield copolymers of polyvinylformamide and polyvinylamine. Exemplary materials are described in U.S. Pat. Nos. 4,880,497 and 4,978,427. These commercial products are believed to have a molecular weight range of about 300,000 to 1,000,000 Daltons, though polyvinylamine compounds having any practical molecular weight range can be used. For example, polyvinylamine polymers can have a molecular weight range of from about 5,000 to 5,000,000, more specifically from about 50,000 to 3,000,000, and most specifically from about 80,000 to 500,000. Polyvinylamine compounds that may be used in the present invention include copolymers of N-vinylformamide and other groups such as vinyl acetate or vinyl propionate, where at least a portion of the vinylformamide groups have been hydrolyzed.

In an exemplary embodiment, the strength additive is polyethyleneimine which is preferably obtained by cationically initiated polymerization of ethyleneimines and also the reaction products of the polymers with, for example, ethylene oxide, propylene oxide, dialkyl carbonates such as ethylene carbonate or propylene carbonate, lactones such as butyrolactone, urea, formaldehydeamine mixtures, carboxylic acids such as formic acid, acetic acid or vinylacetic acid. Such reaction products may contain, based on the polyethylenelmine, up to 400% by weight of ethylene oxide and/or propylene oxide and up to 200% by weight for the other compounds. Ethyleneimines are polymerized cationically using as the catalyst for example Bronsted acids such as sulfuric acid, phosphoric acid, p-toluenesulfonic acid or carboxylic acids such as formic acid, acetic acid or propionic acid or Lewis acids such as halides, for example zinc chloride or alkyl halides such as methyl chloride, ethyl chloride, benzyl chloride or ethylene chloride. Suitable polyethyleneimines can also be obtained by reacting ethylene chloride with ammonia and amines. The molecular weights of the polyethyleneamines are within the range from 400 to 200,000, and preferred polyethyleneimines are obtainable by polymerizing ethyleneimine. Polymers of this kind are commercial products. In addition, it is also possible to use polyalkylenepolyamines containing from 10 to 4,500 nitrogen atoms in the molecule.

The softener composition may optionally further comprise emulsifiers, stabilizers, couplers, defoamers, surfactants, wetting aids, paper strength aids or mixtures thereof.

In another aspect, the present invention provides a method for producing a paper product.

Principally, a process of producing paper comprises three steps:

- forming an aqueous slurry i.e. paper slurry, of cellulosic fibers which may be accompanied with other fibers, as well;
- adding a strength additive, and optionally softeners, sizing agents, retention aids etc.;
- sheeting and drying the fibers to form a desired cellulosic web.

The forming of an aqueous slurry of cellulosic fibers can be performed by conventional means, such as by mechanical, chemical or semi-chemical means. After mechanical grinding and/or pulping step, the pulp is washed to remove residual pulping chemicals and solubilized wood components.

The strength additives, typically wet-strength and dry-strength resins, may be added directly to the papermaking system.

The step of sheeting and drying the fibers to form a cellulosic web, may be carried out by conventional means.

Softeners and softener compositions can be added to the papermaking process at any point in the process where softeners and softener compositions are usually added. Softeners and softener compositions can be added at any time before, during or after the paper is formed.

Aldehyde functionalized polymers, such as glyoxylated polyacrylamide polymer (GPAM) in particular, possibly together with other strength additive polymers, can be added to the papermaking process at any point in the process where strength resins are usually added. Aldehyde functionalized polymers and other strength additive polymers can be added at any time before, during or after the paper is formed. For example, aldehyde functionalized polymers can be added before, or after the refining of the pulp at the fan pump, or head box, or by spraying or by other means on the wet web. Typically, the aldehyde functionalized polymer is added at the fan pump or machine chest in the form of an aqueous solution.

More particularly the present invention provides a method for manufacturing a paper product, which comprises the steps of

- providing a pulp slurry,
- forming a web from the pulp slurry, drying the web, adding the softener composition described above (i) to the pulp slurry before web formation, (ii) on the web before, during and/or after the drying, and/or (iii) on wire, on forming fabric or on Yankee dryer on the web-contacting side.

In one embodiment the softener composition is added to the pulp slurry before web formation. As an example, the softener composition may be added to the slurry in a machine chest or, preferably, in a headbox of a paper machine. By addition to the pulp slurry, the softener composition distributes throughout the web.

In one embodiment the softener composition is added on the web before drying, i.e. the softener composition may be added to any stage after a headbox before the web enters a dryer section of a paper machine. As exemplary embodiments, the composition may be added on the web before, during and/or after dewatering, or on the web in a (wet) press section of a paper machine. The press section, located after dewatering/drainage section, removes much of the remaining water via a system of nips formed by rolls pressing against each other aided by press felts that support the sheet and absorb the pressed water. By adding on the web before drying, the softener composition retains on paper surface and enhances paper surface smoothness with minimal paper strength loss.

In one embodiment the softener composition is added on the web during drying, i.e. the softener composition is added on the web during the web is subjected to drying in a dryer section of a paper machine. The dryer section of a paper machine dries the paper typically by way of a series of internally steam-heated cylinders that evaporate the moisture.

In one embodiment the softener composition is added on the web after the drying, i.e. the softener composition is added on the web after the web leaves dryer section of a paper machine. By adding after the drying, the softener composition retains on paper surface and enhances paper surface smoothness with minimal paper strength loss.

In one embodiment the softener composition is added on wire, on forming fabric or on Yankee dryer on the web-contacting side which will be in contact with the web. The softener composition transfers to the web during the contact.

The softener composition may be added into one, two or several stages of a paper machine.

In one embodiment the softener and the acidic material of the softener composition are added separately. The softener and the acidic material may be added to same step separately or to different steps. The softener may be added first followed by addition of the acidic material to same or different step. Or the acidic material may be added first and then the softener to same or different step. The acidic material is preferably added in liquid form, more preferably as an aqueous solution.

In one embodiment the softener, the acidic material and the optional aldehyde functionalized polymer of the softener composition are added separately. The softener, the acidic material and the optional aldehyde functionalized polymer may be added to same step separately or to different steps in any possible orders.

The softener composition or the components (the softener, the acidic material and the optional aldehyde functionalized polymer) of the softener composition may be applied by spray or other means to a fibrous web. For example, spray nozzles may be mounted over or under a moving paper web to apply a desired dose to the web which may be moist or substantially dry.

Application of the softener composition or the components of the softener composition by spray or other means to a moving belt or fabric which in turn contacts the web to apply the acid to the web, such as is disclosed for example in WO 01/49937.

The softener composition or the components of the softener composition may be applied by printing onto a web, such as by offset printing, gravure printing, flexographic printing, ink jet printing, digital printing of any kind, and the like.

The softener composition or the components of the softener composition may be applied by coating onto one or both surfaces of a web, such as blade coating, air knife coating, short dwell coating, cast coating, and the like.

The softener composition or the components of the softener composition may be applied to individualized fibers. For example, comminuted or flash dried fibers may be entrained in an air stream combined with an aerosol or spray of the compound to treat individual fibers prior to incorporation to a web or other fibrous product.

The softener composition or the components of the softener composition may be applied by impregnation into a wet or dry web from a solution or slurry.

One useful method for impregnation of a moist web is the Hydra-Sizer® system, produced by Black Clawson Corp., Watertown, N.Y., as described in "New Technology to Apply Starch and Other Additives," Pulp and Paper Canada, 100 (2): T42-T44 (February 1999). This system includes a die, an adjustable support structure, a catch pan, and an additive supply system. A thin curtain of descending liquid or slurry is created which contacts the moving web beneath it. Wide ranges of applied doses of the coating material are achievable with good runnability. The system can also be applied to curtain coat a relatively dry web, such as a web just before or after creping.

The softener composition or the components of the softener composition may be applied by foam application to a fibrous web (e.g., foam finishing), either for topical application or for impregnation into the web under the influence of a pressure differential (e.g., vacuum-assisted impregnation of the foam). Principles of foam application of additives such as binder agents are described in the following publications: F. Clifford, "Foam Finishing Technology: The Controlled Application of Chemicals to a Moving Substrate," Textile Chemist and Colorist, Vol. 10, No. 12, 1978, pages 37-40; C. W. Aurich, "Uniqueness in Foam Application," Proc. 1992 Tappi Nonwovens Conference, Tappi Press, Atlanta, Ga., 1992, pp. 15-19; W. Hartmann, "Application Techniques for Foam Dyeing & Finishing", Canadian Textile Journal, April 1980, p. 55; U.S. Pat. No. 4,297,860, "Device for Applying Foam to Textiles," issued Nov. 3, 1981 to Pacifici et al., herein incorporated by reference; and U.S. Pat. No. 4,773,110, "Foam Finishing Apparatus and Method," issued Sep. 27, 1988 to G. J. Hopkins, herein incorporated by reference.

The softener composition or the components of the softener composition may be applied by padding of a solution containing the softener composition or the components of the softener composition into an existing fibrous web.

The softener composition or the components of the softener composition may further be applied by roller fluid feeding, or roll coating, of a solution containing the softener composition or the components of the softener composition for application to the web. Roll coating technique is commonly used for the application of a solution, such as liquid adhesives, paints, oils, and coatings, to the surface of a substrate, such as on a web. Roll coaters may include one or multiple rollers in simple or sophisticated arrangement. A roll coating machine works by applying the solution from the surface of a roller to the surface of a substrate. When this happens, a phenomenon known as "film splitting" occurs. The layer of solution on the surface of the roll splits, part of it staying on the roller, and part transferring to the surface of the substrate. The percentage transferring depends on the surface characteristics of both the roller and the substrate. With most roll coaters, there is a control means for controlling the thickness of the coating on the surface of the roller before it contacts the substrate. The three most common approaches to controlling the coating thickness are metering blade, metering roller, and transfer from another roll. In a typical arrangement for a metering blade, the coating is picked up from a reservoir by the application roller, and as the coating clings to the roller and is carried up by the rotation of the roller, only a certain amount passes through the gap between the metering blade and the roll surface. The excess flows back to the tank. Metering blades are usually made with adjustment means, so coating thickness changes are made by moving the blade to open or close the gap.

In one embodiment the softener composition or the softener, the acidic material and the optional aldehyde functionalized polymer of the softener composition may be applied by spraying, padding, printing, coating, foam application, roller fluid feeding and/or impregnating on the formed web and/or the dried web. Advantageously, the addition is made by spraying.

One skilled in the art will recognize that the softener composition or the components of the softener composition can be distributed in a wide variety of ways. For example, the softener composition or the components of the softener composition may be uniformly distributed, or present in a pattern in the web, or selectively present on one surface or in one layer of a multi-layered web. In multi-layered webs, the entire thickness of the paper web may be subjected to application of the softener composition or the components of the softener composition and other chemical treatments described herein, or each individual layer may be independently treated or untreated with the softener composition or the components of the softener composition and other chemical treatments of the present invention.

In one embodiment, the softener composition or the components of the softener composition of the present invention are applied to one layer in a multilayer web. Alternatively, in another embodiment at least one layer is treated with significantly less softener composition or components of the softener composition than the other layers.

If the softener composition or the acidic material is added to the pulp slurry, the dosage of the softener composition or the acidic material is required to be higher for neutralizing alkalinity in the papermaking water system compared to application onto the web.

In an exemplary embodiment the pulp slurry pH is from 4.0 to pH 9.0.

In various embodiments of the present invention the softener composition or the acidic material is applied onto the web in such an amount that the surface of the web becomes acidic. The acidity of the web surface may be measured by standard methods, including standard Tappi methods for measuring the surface pH, such as T509 and T529.

Measured by the above described method, the softener composition or the acidic material may comprise one or more acids providing a pH value below 8. In one embodiment, the softener composition or the acidic material comprises one or more acids providing a pH value below 7. In one embodiment, the softener composition or the acidic material comprises one or more acids providing a pH value below 6. In one embodiment, the softener composition or the acidic material comprises one or more acids providing a pH value below 5. In another embodiment, the softener composition or the acidic material comprises one or more acids with a pH value below 4 to provide significant paper strength enhancement.

In one embodiment of the present invention a method is provided which comprises the steps of providing a pulp slurry,
forming a web from the pulp slurry,
drying the web,
adding the softener composition defined above
(i) to the pulp slurry before web formation,
(ii) on the web before, during and/or after the drying, and/or
(iii) on wire, on forming fabric or on Yankee dryer on the web-contacting side,
adding the aldehyde functionalized polymer defined above
(a) to the pulp slurry before web formation, and/or
(b) on the web before, during and/or after the drying.

In one embodiment the aldehyde functionalized polymer is added before, after or simultaneously with the softener composition.

In one preferred embodiment of the present invention a method is provided which comprises the steps of providing a pulp slurry,
forming a web from the pulp slurry,
drying the web,
adding the aldehyde functionalized polymer defined above to the pulp slurry before web formation, and
adding the softener composition defined above on the web before drying.

In one embodiment the softener composition is added in an amount of from 0.01 wt % to 5 wt % based on paper dry weight.

In one embodiment the softener composition is added on the web before drying in an amount of from 0.01 wt % to 1 wt % based on paper dry weight.

In one embodiment the softener composition is added on the web after the drying in an amount of from 0.01 wt % to 5 wt % based on paper dry weight.

In one embodiment the aldehyde functionalized polymer is added in an amount of from 0.01 wt % to 1 wt % based on paper dry weight.

Yet in another aspect, the present invention provides a paper product produced with the method described above. The treated paper product has improved softness and also enhanced initial wet strength.

Yet in another aspect, the present invention provides a chemical treatment system for fibers in the manufacture of paper product comprising the softener composition described above and an aldehyde functionalized polymer described above. In the chemical treatment system the softener composition and the aldehyde functionalized polymer may be in a form of a composition or a mixture. Or the softener composition and the aldehyde functionalized polymer may be separately as a kit. In other words, the kit comprises the softener composition and the aldehyde functionalized polymer. The softener composition and the aldehyde functionalized polymer are applied to paper manufacture process at the same time or separately.

The invention is further illustrated by the following non-limiting examples.

EXAMPLES

Experimental

Materials

Fennosoft 868NV was an imidazoline-based softener product from Kemira Chemicals. Fennobond 3300 was a GPAM product from Kemira Chemicals. Citric acid (99%) was purchased from Sigma Aldrich. SuperFloc A120 HMW was a dry anionic polyacrylamide product from Kemira Chemicals. For the following experiments, SuperFloc A120 HMW was first dissolved in de-ionized water at a concentration of 0.1 wt % before adding to pulp slurries.

Softener Emulsification

All softener emulsions were prepared in the lab by physical mixing using a commercial blender for 30 seconds.

Hand Sheet Preparation

Hand sheets were prepared using a mixture of bleached northern hardwood (50%) and bleached softwood (50%) with a final Canadian Standard Freeness (CSF) of 450 mL. The pulp mixture had a consistency of 0.4% and its pH was adjusted using diluted NaOH and HCl. During handsheet preparation, softener emulsion, FennoBond 3300, and SuperFloc A120 HMW were first added to the pulp slurry sequentially and then mixed for two minutes. Next, four 3-g sheets of paper were formed using a standard (8"×8") Nobel & Woods handsheet mold, to target a basis weight of 52 lbs/3470 ft2. Pulp dilutions during handsheet preparation were carried out using a specially formulated water with 150 ppm of sodium sulfate and 35 ppm of calcium chloride. The pH value of the dilution water was adjusted to be the same as the pulp slurry using dilute NaOH and HCl. Last, the formed hand sheets were pressed between felts in the nip of a pneumatic roll press at about 15 psig and dried on a rotary dryer at 110° C. for 45 seconds and conditioned in the standard TAPPI control room for 24 hours.

Dry Tensile Strength Test

Tensile strength is measured by applying a constant-rate-of-elongation to a sample and recording the force per unit width required to break a specimen. This procedure references TAPPI Test Method T494 (2001), and modified as described.

Initial Wet Tensile Strength Test

Initial wet tensile strength test method is used to determine the initial wet tensile strength of paper or paperboard that has been in contact with water for 2 seconds. A 1-inch wide paper strip sample is placed in the tensile testing machine and wetted on both strip sides with deionized water by a paint brush. After the contact time of 2 seconds, the strip is elongated as set forth in 6.8-6.10 TAPPI test method 494 (2001). The initial wet tensile is useful in the evaluation of the performance characteristics of tissue product, paper towels and other papers subjected to stress during processing or use while instantly wet. This method references U.S. Pat. No. 4,233,411, and modified as described.

Wet/Dry Ratio

Wet/dry ratio is the initial wet tensile strength as expressed as a percentage of dry tensile strength.

EXAMPLES

Tables 1 and 2 list four softener emulsion compositions and also their viscosities. Sample 1 was prepared with 10 wt % softener FennoSoft 868NV and no citric acid. Its initial viscosity was 357 cps and increased dramatically to 1110 cps upon aging for 10 days at 35° C. and 39 days at 23° C. In comparison, Samples 2 and 3 were prepared with 10 wt % softener and also 5 wt % and 15 wt % citric acid respectively. Their initial viscosities were only 13 and 10 cps, significantly lower than that of Sample 1. Upon aging, Samples 2 and 3 did not show any significant viscosity change. Low viscosity emulsions are desirable by chemical suppliers and papermakers since they can be handled easily without the need of special pumping and mixing equipment. Sample 4 was prepared with a higher softener concentration of 15 wt % and also 15 wt % citric acid. This new emulsion showed an initial viscosity of 558 cps and an aged viscosity of 1060 cps, which was comparable to that of Sample 1. Sample 4 demonstrated clearly that imidazoline-based softeners can be prepared at relatively higher concentrations in the presence of citric acid, resulting in significant cost savings on shipping and handling.

Table 3 compares Sample 1 and Sample 3 regarding their impacts on paper strength properties. The composition difference between these two samples was that Sample 1 contained no citric acid but Sample 3 contained 15% citric acid. First, both samples decreased paper dry tensile strength significantly by 24-29% under various conditions. Lower dry tensile strength often improves perceptive softness and is therefore desirable for many premium tissue products. This result suggests that the presence of citric acid had minimum impact on paper dry strength and softness. Next, Sample 1 also decreased paper wet tensile strength significantly. Upon adding to the pulp slurry, cationic softeners are believed to absorb on the fiber surface and interrupt fiber-fiber bonding, leading to decreased dry strength and wet strength. Unlike Sample 1, Sample 3 provided comparable or higher wet tensile strength as the control (Example 1). Higher wet tensile strength is often highly desirable by consumers when the tissue product is used in contact with water. The advantage of Sample 3 over Sample 1 was also clearly demonstrated by the ratio of wet tensile strength over dry tensile strength (wet/dry ratio). Under all tested conditions, Sample 3 gave considerably higher wet/dry ratios. Finally, the aging process in the invention showed no impact on softener performance.

TABLE 1

Softener emulsion composition

| Samples | Fennosoft 868NV (wt %) | Citric acid (wt %) | Water | Estimated RA |
|---|---|---|---|---|
| 1 | 10 | 0 | 90 | 0 |
| 2 | 10 | 5 | 85 | 0.39 |
| 3 | 10 | 15 | 75 | 1.17 |
| 4 | 15 | 15 | 70 | 0.78 |

TABLE 2

Viscosities of softener emulsions

| Samples | Initial viscosity (cps) | Aged viscosity (35° C. for 10 days) (cps) | Aged viscosity (35° C. for 10 days + 23° C. for 39 days) (cps) |
|---|---|---|---|
| 1 | 357 | 757 | 1110 |
| 2 | 13 | 18 | 18 |
| 3 | 10 | 17 | 19 |
| 4 | 558 | 979 | 1060 |

TABLE 1

Effects of softener emulsion on paper strength properties. Aged products were stored for 10 days at 35° C. and 39 days at 23° C., FB [3300] = 6 lb/ton, [SF A-120 HMW] = 0.2 lb/ton, [FS 868NV] = 4 lb/ton.

| Example | Chemicals | pH of pulp and dilution water | Dry tensile (lb/in) | Initial wet tensile (lb/in) | Wet/dry ratio | Wet/dry improvement over Example 1 |
|---|---|---|---|---|---|---|
| 1 | FB 3300 + SF A-120 HMW | 5.5 | 10.6 | 3.3 | 0.31 | 0 |
| 2 | Example 1 (fresh) + FB 3300 + SF A-120 HMW | 5.5 | 7.6 | 2.9 | 0.38 | 23% |
| 3 | Example 3 (fresh) + FB 3300 + SF A-120 HMW | 5.5 | 7.9 | 3.5 | 0.44 | 42% |
| 4 | Example 1 (aged) + FB 3300 + SF A-120 HMW | 5.5 | 7.7 | 2.9 | 0.38 | 21% |
| 5 | Example 3 (aged) + FB 3300 + SF A-120 HMW | 5.5 | 7.9 | 3.4 | 0.43 | 38% |
| 6 | Example 1 (aged) + FB 3300 + SF A-120 HMW | 7.2 | 7.5 | 2.5 | 0.33 | 7% |
| 7 | Example 3 (aged) + FB 3300 + SF A-120 HMW | 7.2 | 8.1 | 3.1 | 0.38 | 23% |

The invention claimed is:

1. A softener composition for use in manufacture of a paper comprising:

a softener selected from: waxes such as paraffins; oils such as mineral oils, silicone oils, petrolatums or mixtures thereof; cationic surfactants such as imidazoline-based surfactants (quaternized or un-quaternized), fatty amines and their derivatives and salts, cationic silicone compounds, or mixtures thereof; nonionic surfactants such as fatty alcohols, fatty amides, fatty acid esters, ethoxylated alcohols, ethoxylated fatty acids, alkyl polyglucosides, ethoxylated alkyl phenols, ethleneoxide/propyleneoxide copolymers or mixtures thereof; anionic surfactants such as fatty acids, sulfonates, sulfates, carboxylates, alkyl phosphates, anionic silicone surfactants or mixtures thereof; lubricants; emollients such as lanolin, lecithin or mixtures thereof; a reaction product of 9-octadecenoic acid (9Z)- with diethylenetriamine, cyclized, diethyl sulfate quaternized, or dimethyl sulfate quaternized; or mixtures of any of the foregoing; and an acidic material selected from phosphoric acid, boric acid, sulfuric acid, hydrochloric acid, nitric acid, formic acid, acetic acid, citric acid, lactic acid, adipic acid, malic acid, an acrylic acid-containing polymer, a conjugate acid of a weak base, an amine-containing polymer in partially or fully protonated form, or any mixture thereof, wherein the softener composition has a relative acidity (RA) value of more than 0.05, the RA value calculated using the following equation $$RA = \frac{TA}{c_s}$$

where TA is the total acidity of the composition in CaCO3 equivalent (g/l), $c_s$ is the concentration of softener (g/l) in the composition, and wherein the softener reduces paper surface friction coefficient, increases paper surface lubricity, reduces paper stiffness, increases paper bulk, reduces paper strength (wet and dry), plasticizes paper and prevents fiber-fiber bonding (debonding) and wherein the composition further comprises glyoxylated polyacrylamide (GPAM).

2. The softener composition according to claim 1, wherein the RA value is from 0.05 to 100.

3. The softener composition according to claim 1, wherein the acidic material comprises a mixture of acids.

4. The softener composition according to claim 1, wherein weight ratio of the softener to the acidic material is from 100:1 to 1:100.

5. The softener composition according to claim 1, wherein the composition further comprises emulsifiers, stabilizers, couplers, defoamers, surfactants, wetting aids, paper strength aids or mixtures thereof.

* * * * *